United States Patent [19]

Hickey

[11] 3,935,979

[45] Feb. 3, 1976

[54] WEB ALIGNMENT APPARATUS FOR MULTI-LEVEL WEB MATERIAL

[75] Inventor: Thomas L. Hickey, Downingtown, Pa.

[73] Assignee: Rockford Servo Corporation, Rockford, Ill.

[22] Filed: Oct. 21, 1974

[21] Appl. No.: 516,757

[52] U.S. Cl. ..... 226/19; 226/23; 226/45

[51] Int. Cl.[2] ..... B65H 25/26

[58] Field of Search ..... 226/18, 19, 21, 22, 23, 226/45; 73/37.7; 137/805, 83

[56] References Cited

UNITED STATES PATENTS

| | | | |
|---|---|---|---|
| 3,079,805 | 3/1963 | Rojecki | 226/23 X |
| 3,184,374 | 5/1965 | Pearson | 226/19 X |
| 3,504,835 | 4/1970 | Callan | 226/23 |
| 3,750,920 | 8/1973 | Fountain et al. | 226/23 |
| 3,826,487 | 7/1974 | Forster et al. | 73/37.7 X |

*Primary Examiner*—Allen N. Knowles
*Attorney, Agent, or Firm*—Morsbach & Pillote

[57] ABSTRACT

A web alignment apparatus for use with multi-level web material such as carpeting, tufted fabrics and the like having a backing web and a pile on the backing web inwardly of the side edge of the backing web. The web alignment apparatus senses the pile edge and operates to maintain the pile edge in a preselected course relative to an apparatus that operates on the web. The sensor includes a web engaging member movable in a first path generally paralling the plane of the web to sense lateral deviations of the pile edge from the desired course of travel and the web engaging member is also movable in a second path transverse to the plane of the web to sense if the web engaging member rides onto the pile material, and the sensor is arranged to produce a signal when moved in either the first or second paths to operate the web alignment apparatus accordingly to shift the web relative to the apparatus operating thereon in a direction to bring the pile edge to the desired course of travel.

16 Claims, 7 Drawing Figures

W
31a
31
38
D
33
37
32
65
43
128
43a
A
55
3
62
63
41
61
55c
2
64
43b
36
128
128a
W3
W2
34
35
W1
53b
126
53a
127
111a
111
143a
143
144
P1
Px
P2
V1
Vx
V2
42
93a
106
100
101
104
102
108
113
121d
105
114
121b
103
107
125b
93
121a
90
121c
125c
R
121
124
91b
121e
125
92
91
123
122
91a

WEB ALIGNMENT APPARATUS FOR MULTI-LEVEL WEB MATERIAL

BACKGROUND OF THE INVENTION

In web alignment apparatus for multi-level web material such as carpeting, tufted fabrics and the like having a backing web and pile on the backing web spaced inwardly from the edge of the backing web, it is frequently desirable to maintain the edge of the pile in a preselected relation to an apparatus which operates on the web, independent of the lateral position of the edge of the backing web. This necessitates sensing the line of juncture between the backing web and the pile edge and this poses some problem if the backing web is such that it is not possible to pass either an air stream or a light beam through the backing web to sense the edge of the superposed face web or pile.

The U.S. Pat. No. 3,244,428 to Henderson discloses an electrical pile edge sensing apparatus which utilizes a plurality of contact fingers, some of which normally rest on the pile and others of which normally rest on the backing adjacent the pile, and which contact fingers operate switches to control positioning of the pile edge in accordance with the relative positions of the contact fingers. Such a pile edge sensing apparatus, however, can only effect a step type control and the pile edge can shift laterally a significant distance before one of the contact fingers either rides onto or off of the pile to change the electrical signal.

Pneumatic type pile edge sensing apparatus have also been heretofore made utilizing a tightly coiled spring as an air bleeder valve. The tightly coiled spring was rigidly supported at one end with its axis inclined at an acute angle to a longitudinal plane through the edge of the pile on the web, and a web engaging member rigidly attached to the other end of the coil spring and arranged to engage the pile edge so that the convolutions of the coil spring were spearated to variably open the valve when the web engaging member was either moved laterally by the pile edge or the web engaging member rode onto the pile. However, the convolutions of the spring which formed the bleeder valve also controlled the pressure exerted by the web engaging member on the web and pile edge and some difficulties were encountered in sensing the pile edge on webs which did not have a firm and well defined pile edge, such as occurs when the pile is thin, soft or loose. The web engaging member of the sensor sometimes tends to ride on top of the pile instead of sensing the pile edge and the prior coil spring type pneumatic sensor was not always sensitive enough to sense and produce an appropriate correction signal when the web engaging member rode on top of a thin, soft or loose pile.

SUMMARY OF THE INVENTION

It is a general object of the present invention to provide a web alignment apparatus for multi-level web materials having an improved pile edge sensor which is sufficiently sensitive to use with a wide range of multi-level webs including those having relatively thin, soft or loose pile.

The web alignment apparatus of the present invention includes a gap-type pneumatic sensor having a sensing orifice at one side of the gap and a transmitting orifice at the other side of the gap for transmitting a stream of air toward the sensing orifice and a vane extending into the gap to variably interrupt the stream of air and thereby vary the pneumatic signal at the sensing orifice, together with a web engaging member that is adapted to engage the pile edge and which is mounted for movement in a first path crosswise of the course of travel of the pile edge and generally parallel to the plane of the web to sense lateral deviations of the course of travel of the pile edge from a preselected lateral position and also in a second path transverse to the plane of the web to sense if the web engaging member rides onto the pile, and the web engaging member is operatively connected to the vane to move the latter in the gap and variably interrupt the stream of air from the transmitting orifice to the sensing orifice in response to movement of the web engaging member along either its first or second paths. Power means responsive to variations in pressure of the sensing orifice produced by movement of the vane crosswise of the stream of air is provided for effecting relative shifting of the web and the device which operates on the web to maintain the pile edge in a preselected lateral position.

The optimum pressure which should be exerted by the web engaging member on the web and pile edge to cause the web engaging member to closely follow the pile edge will vary for different webs dependant on various factors including pile stiffness and density and speed of travel of the web. Accordingly, another object of this invention is to provide a pile edge sensor which enables adjustment of the lateral pressure exerted by the web engaging member on the pile edge and also enables independent adjustment of the pressure exerted by the web engaging member in a direction perpendicular to the web.

A seam in the web frequently produces a protuberance from the normal plane of the web backing material and which protuberance, when engaged by the web engaging member, would produce a signal similar to the signal produced by the web engaging member riding onto the pile, even though the pile edge at the seam was not actually misaligned. Another object of the invention is to provide a web sensing apparatus having means for sensing when the web engaging member contacts a seam and for preventing the power means from correcting the web position until after the seam is passed.

These, together with other objects and advantages of the present invention will be more readily understood by reference to the following detailed description when taken in connection with the accompanying drawings wherein.

Figures 1, 7:
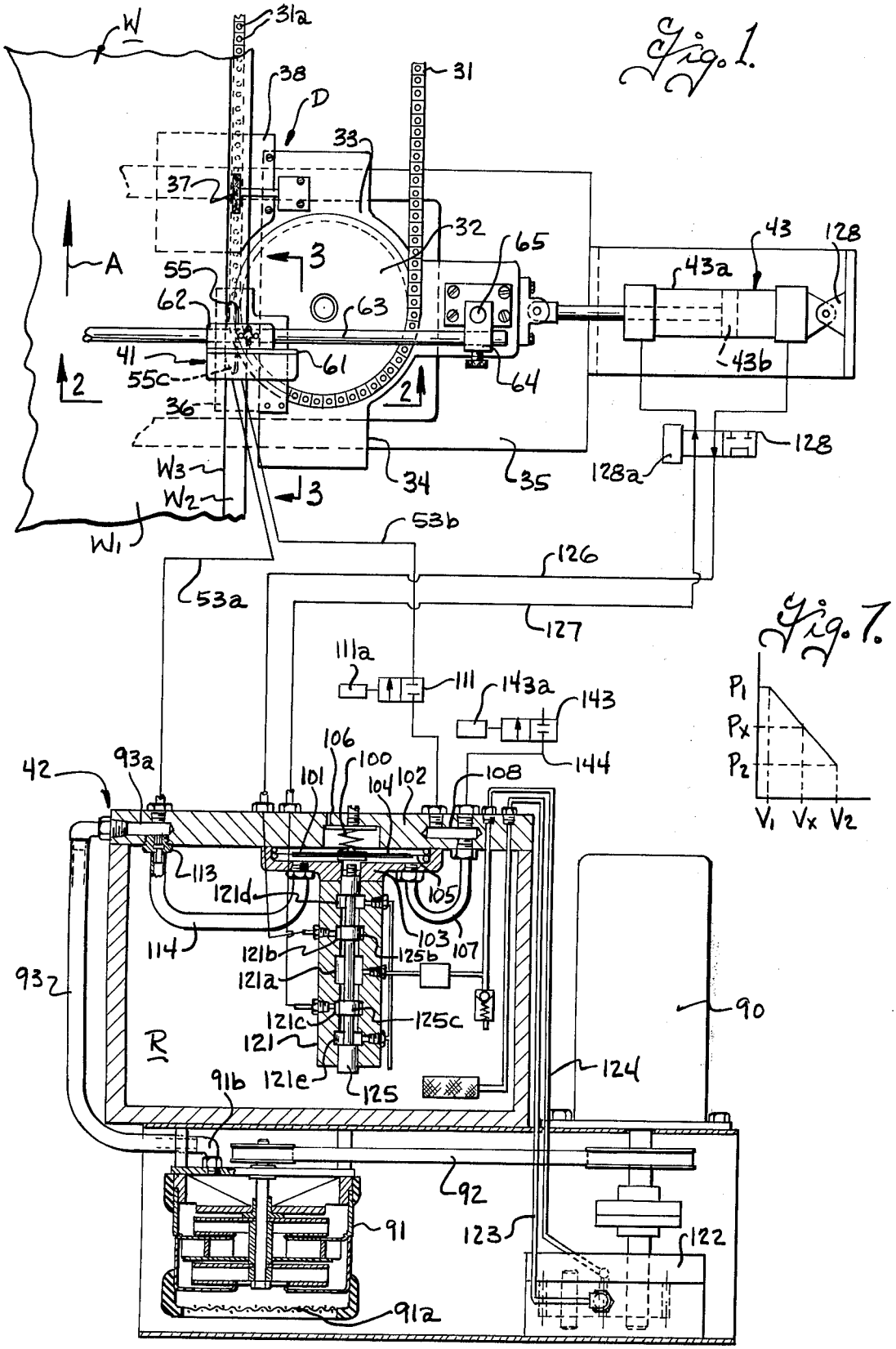
FIG. 1 is a diagrammatic view illustrating a web alignment apparatus for multi-level web material and embodying the improved pile edge sensing apparatus of the present invention.
FIG. 7 is a chart illustrating variations in pressure produced by the pile edge sensing apparatus in response to movement of the web engaging member.

The web alignment apparatus is adapted for aligning multi-level web material W such as carpeting, tufted fabrics the the like wherein the face web W1 formed by the tufts or pile is spaced inwardly of the side edge of the backing web W2 and defines a discrete step or pile edge W3 at the line of juncture between the pile and backing webs. In the handling of such multi-level materials, it is frequently desired to maintain the pile edge W3 of the face web, that is the side edge of the line of pile in a carpet or the like, in a preselected course of travel relative to a device such as designated generally by the letter D which operates on the web. The web alignment apparatus may be arranged for operation as a web chasing system in which the alignment apparatus automatically shifts the device D laterally relative to the web W in a direction to maintain the device D in a preselected lateral position relative to the pile edge W3 or, alternatively, may be used in a web guiding system in which the web W is laterally shifted relative to the device D to maintain the pile edge W3 in a preselected position laterally relative to the device D. The web alignment apparatus is diagrammatically shown in FIG. 1 applied to a tenter frame of known construction. Such tenter frames in general include elongated chains designated 31 having means such as tenter clamps or pins 31*a* for engaging the web edge. In FIG. 1, one tenter chain is shown for one side edge of the web W, it being understood that a similar tenter chain is also provided for the other side edge of the web. The inlet ends of the tenter chains are entrained over sprockets 32 which are rotatably driven by a suitable means (not shown), and which sprockets are rotatably supported on a movable support structure 33. The support structure is guided as by guideways 34 on a stationary support structure 35 for movement in a direction crosswise of the course of travel of the web, which course is designated by the arrow A. The web W, as it enters the tenter frame, is guided by an inlet guide plate 36 disposed at a level above the tops of the pins 31 on the tenter chains 31 and, after the web passes the inlet sprocket, it is pressed downwardly as by a roller or brush 37 onto the pins 31*a*. A means such as a guide plate 38 underlies the web W in the region where the web is pressed onto the tenter pins to support the web. As shown, the guide plate 38 and the roller 37 are conveniently supported on the movable structure 33 for movement therewith laterally of the web, and the inlet guide plate 36 is similarly mounted on the movable support structure 33 for movement therewith. While the web alignment apparatus as herein shown applied to a shiftable tenter frame, it is to be understood that the device D which operates on the web W can be of different forms and may, for example, be a laterally adjustable end wall in an ink dam utilized for dyeing carpeting, wherein the end wall is maintained in a preselected relation to the edge W3 of the carpet pile.

The web alignment apparatus in general includes a sensor 41 for sensing the lateral position of the pile edge or step W3 between the face W1 and the backing web W2; a control system 42 which responds to the signals produced by the sensor 41 and which reversably controls the application of power to an actuator 43 which operates to relatively shift the web W and the device D in a direction to maintain the pile edge in a preselected pass laterally relative to the device D.

The web edge sensor 41 is of a pneumatic type and includes a gap-type pneumatic sensor 51 having a transmitting orifice 51*a* in a leg at one side of the gap and a sensing orifice 51*b* in a leg at the other side of the gap and a vane 54 which is movable in the gap to variably interrupt the stream of air from the transmitting orifice to the sensing orifice and to vary the pressure conditions at the latter. A web engaging member 55 is adapted to engage the pile edge W3 on the web and is operatively connected to the vane 54 for moving the latter in the gap of the sensor 51. In accordance with the present invention, the web engaging member 55 is mounted for movement in a first path crosswise of the course of travel of the pile edge and generally parallel to the plane of the web to sense lateral deviations of the course of travel of the pile edge from a preselected lateral position and the web engaging member is also mounted for movement in a second path generally perpendicular to the plane of the web at the sensing location to sense when the web engaging member rides onto the pile. More particularly, the sensor includes a main support conveniently in the form of a plate 61 which is mounted as by a bracket 62 on a support bar 63. In the web chasing system illustrated, the support bar 63 is, in turn, mounted by a bracket 64 and post 65 (FIG. 1) on the movable support structure 33 for movement therewith so that the web sensor moves laterally with the device D that operates on the web. Alternatively, in a web guiding system wherein the device D that operates on the web is mounted at a laterally fixed location and the web is shifted laterally relative to the device D, then the support bar 63 would be similarly mounted at a laterally fixed location.

The web engaging member is mounted on the plate 61 by first and second support arms 68 and 71. The first support arm 68 is pivotly mounted on the plate for movement about a pivot axis 69 parallel to the pile edge W3 and spaced above and laterally offset from the sensing location. The arm 68 extends generally parallel to the plane of the web W2 and the second support arm 71 is pivotly mounted on the first arm for movement relative thereto about a second pivot axis 72 disposed above and generally parallel to the course of travel of the pile edge W3. The web engaging member 55 is attached as by a rod 73 to the lower end of the second arm 71 and, advantageously, the rod 73 extends into the passage 71*a* in the support arm 71 to allow limited vertical adjustment of the rod relative to the arm, and a means such as a thumb screw 75 is provided on the arm for locking the rod in adjusted position. The web engaging member 55 is thus supported for swinging movement about the pivot axis 72 so that the web engaging member can move in a path crosswise of the course of travel of the pile edge W3 and generally parallel to the plane of the web to sense lateral deviations of the course of tavel of the pile edge. Moreover, since the pivot axis 72 is mounted on the arm 68, the web egaging member can also move in a second path perpendicular to the plane of the web to sense if the web engaging member rides onto the pile W1. In order to assure movement of the web engaging member in a direction transverse to the web when it rides onto the pile, as contrasted to merely riding between adjacent rows of tufts on a web backing, the web engaging member is preferably formed with a relatively wide blade portion 55*a* disposed at a shallow angle with respect to the plane of the web and having a lengthwise extending edge 55*b* adapted to engage the pile edge adjacent its juncture with the backing web. The inlet end of the blade 55 is advantageously curved as shown at 55*c* (FIGS. 1 and 3) to guide the tufts or pile toward the lengthwise guide edge 55*b*.

Figure 3:
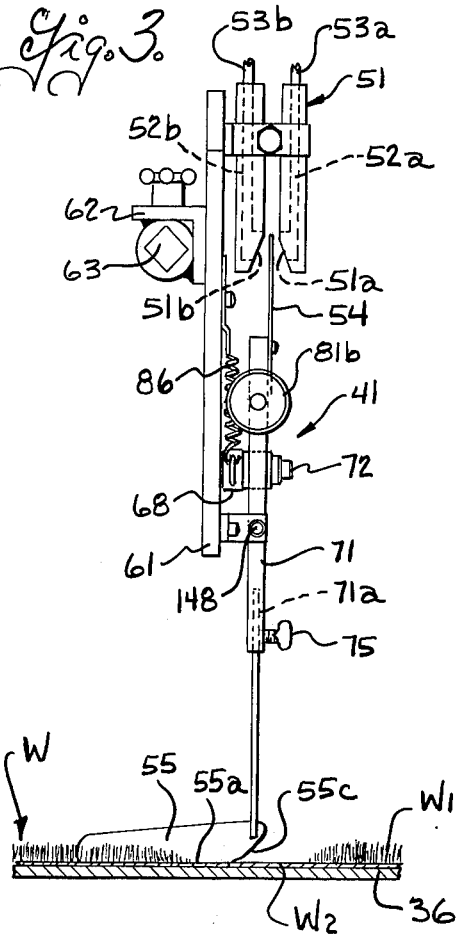
FIG. 3 is a side elevational view taken on the plane 3—3 of FIG. 1 and illustrating the pile edge sensing apparatus in a larger scale than FIG. 1.
Figure 2:
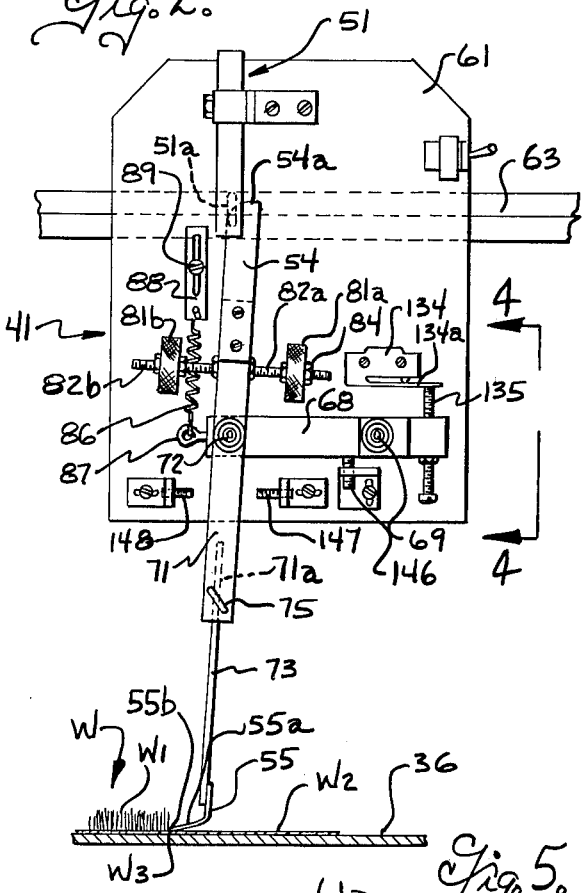
FIG. 2 is a rear elevational view of the pile edge sensing apparatus taken on the plane 2—2 of FIG. 1 and illustrating the sensing apparatus on a larger scale than FIG. 1.
Figure 4:
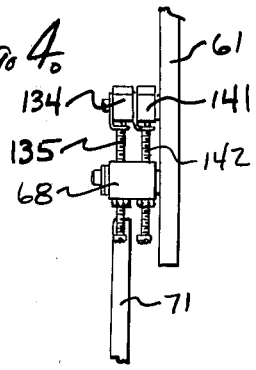
FIG. 4 is a fragmentary enlarged sectional view taken on the plane 4—4 of FIG. 2.
Figure 5:
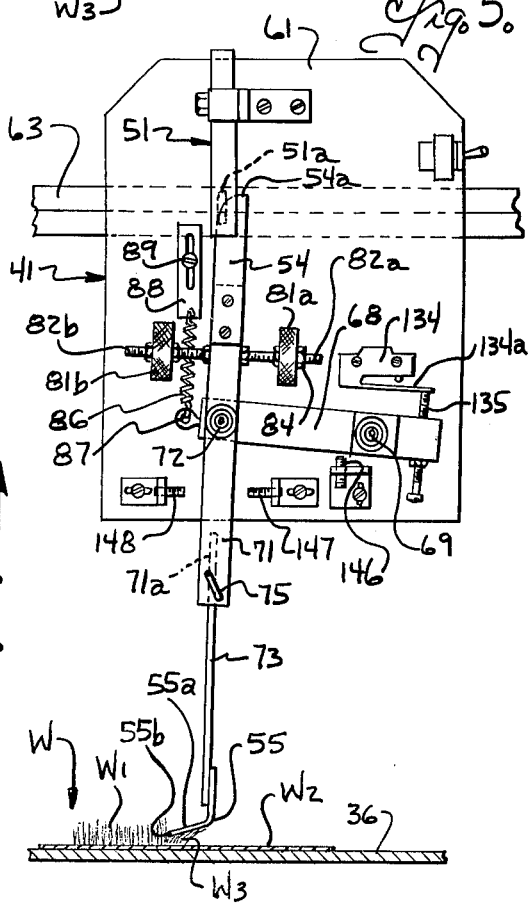
FIG. 5 is a rear elevational view illustrating the pile edge sensing apparatus in a moved position.

Vane 54 is attached to the support arm 71 for movement therewith and, as previously described, extends into the gap between the transmitting and sensing orifice 51*a* and 51*b* to variably interrupt the stream of air from the transmitting to the sensing orifice. As best shown in FIGS. 2, 3 and 5, the transmitting and sensing orifices 51*a* and 51*b* are preferably elongated in a direction transverse to the plane of the web and the vane 54 is formed with leading edge 54*a* shaped to variably interrupt the stream of air from the transmitting orifice to the sensing orifice as the support arm 71 pivots about the axis 72 in response to movement of the web engaging member 55 laterally of the path of travel of the web edge. As will be appreciated, the shape of the edge 54*a* can be changed to change the rate at which the vane interrupts movement of the air stream and to thus change the sensitivity of the sensor. In addition, it will be seen that the vane also variably interrupts the air stream from the transmitting orifice to the sensing orifice in response to movement of the arm 71 in a direction transverse to the plane of the web, as would occur when the web engaging member rides onto the pile or engages a seam in the web. The vane is constructed and arranged in relation to the gap-type sensor so as to produce a similar change in the level of signal at the sensing orifice when the web engaging member is moved either laterally outwardly (to the right as viewed in FIG. 2) or when the web engaging member rides onto the web and moves the vane upwardly as shown in FIG. 5. As described more fully hereinafter, the change in the level of signal at the sensing orifice is arranged to operate the actuator 43 to relatively shift the web and the device that operates thereon to maintain the pile edge in a preselected lateral position relative to the device that operates on the web.

Provisions advantageously made for adjusting the lateral pressure exerted by the web engaging member on the pile edge and, as shown, counterbalance weights 81*a* and 81*b* are adjustably mounted as on screws 82*a* and 82*b* attached to the arm 71. The weights are adjustable along the screws and adapted to be locked into position as by lock nuts 84 to yieldably urge the web engaging member laterally into engagement with the pile edge. Alternatively a light spring or springs can be adjustably interposed between arm 71 and the base plate 61 and arranged to yieldably bias the arm in a direction to press the web engaging member against the pile edge. Provision is also advantageously made for adjusting the pressure exerted by the web engaging member on the web in a direction transverse to the plane of the web. As shown, a spring 86 is attached at one end to a bracket 87 on the outer end of the arm 68 and is attached at its other end to a bracket 88 which is adjustably secured as at 89 to the support plate 61. Bracket 89 can be adjusted relative to the plate 81 to adjust the tension on the spring 88 and hence to adjustably counterbalance the weight of the arms 71 and 68 and the web engaging member, and thereby control the pressure exerted by the web engaging member in a direction transverse to the plane of the web. If the pile edge sensor is used with a vertically extending web, then spring 86 can be rearranged so as to pull the arm 68 in a direction toward the web.

The control apparatus 42 can be of any suitable construction which is adapted to supply air to the transmitting orifice 51*a* of the sensor 51 and to respond to variations in pressure at the sensing orifice 51*b* to control the actuator 43. The control apparatus 42 diagrammatically shown in FIG. 1 is conveniently of the type disclosed in the U.S. Pat. No. 3,407,706 to Robert W. Ott, Jr., dated Oct. 29, 1968. The control apparatus includes a means for supplying air at a substantially constant relatively low pressure, for example 6 to 8 inches of water column. In the embodiment shown, the means for supplying air at substantially constant pressure comprises a centrifugal blower 91 having an atmospheric air inlet 91*a* and an outlet 91*b*, and the blower is driven at a substantially constant speed, as by a belt drive 92 from a motor 90 so as to maintain the air pressure at the outlet 91*b* at a substantially constant value above atmospheric pressure determined by the speed and size and number of stages of the blower 91. The air from the blower 91 is delivered through a line 93 to a pressure chamber 93*a* and the transmitting orifice 51*a* is connected through a passage 52*a* (FIG. 3) and line 53*a* to the pressure chamber 93*a* so that air at a substantially constant pressure is supplied to the transmitting orifice.

The control means also includes a pressure responsive operator herein shown in the form of a diaphragm 101 which is arranged to sense changes in pressure at the sensing orifice 51*b*. As diagrammatically shown in FIG. 1, the diaphragm 101 is clamped between housing members 102 and 103 to define opposed chambers 104 and 105 at opposite sides of the diaphragm. One of the chambers such as 104 is vented to atmosphere as through a vent 106 and the other of the chambers 105 is connected as through a line 107 to an outlet chamber 108. The sensing orifice 51*b* of the gap-type sensor is connected as through passage 52*b* (FIG. 3), line 53*b*, and valve 111 to the outlet chamber 108 so that pressure variations at the sensing orifice are transmitted to chamber 105 and hence to the diaphragm 101. In order to inhibit ingestion of foreign material including dust and the like, the sensing orifice is preferably arranged so as to have a constant flow of air outwardly at a rate somewhat lower than the rate of flow of air from the transmitting orifice and, for this purpose, air under pressure from the conduit 93 is applied through a flow restrictor 113 and line 114 to the chamber 105 for flow through the chamber and through line 107, valve 111 and line 53*b* to the sensing orifice. The flow restrictor 113 is sized to restrict the rate of flow therethrough and hence the rate of flow of air to the sensing orifice to a valve which is low as compared to the rate of flow to the transmitting orifice and just sufficient to prevent ingestion of foreign material at the sensing orifice.

The pressure responsive operator or diaphragm 101 operates a control valve for reversibly supplying fluid to the actuator 43. The control valve comprises a hydraulic four-way reversing valve including a casing 121 having an inlet chamber 121*a*, first and second control chambers 121*b* and 121*c*, and outlet chambers 121*d* and 121*e* that communicate with the reservoir R. Fluid under pressure is supplied to the inlet chamber 121*a* from a hydraulic pump 122 having its inlet connected through a line 123 to a reservoir R and its outlet connected through a line 124 to a valve inlet chamber 121*a*. A valve member 125 is connected to the pressure responsive operator 101 to reversibly control the flow of hydraulic fluid to the control chambers 121*b* and 121*c* and the valve as spaced valve elements 125*b* and 125*c* operative in the neutral position shown to close off communication between the control chambers and both inlet and outlet chambers. As the valve element moves upwardly, it allows the inlet chamber 121*a* to communicate with a control chamber 121 *b* and simultaneously communicate the control chamber 121*c* with the outlet chamber 121*e*. Fluid under pressure is thus reversibly supplied to the control chamber 121*b* and 121*c* and these chambers are connected through hydraulic lines 126 and 127 to the double acting fluid actuator 43. As shown in FIG. 1, the actuator 43 for moving the device D includes a cylinder 43*a* mounted as by a bracket 128 on the stationary support structure 35 and a piston 43*b* in the cylinder having its rod operatively connected to the movable support structure 33 so as to laterally shift the device D. For reasons described hereinafter, an actuator control valve 128 is provided in the lines 126 and 127 to control the application of fluid pressure to the fluid actuator 43.

When the valve 54 is positioned out of the gap, the stream of air from the transmitting orifice 51*a* is directed at the sensing orifice and impedes the flow of air from the sensing orifice such that the pressure at the sensing orifice will then be at a maximum value. As the vane moves into the gap and variably interrupts the stream of air from the transmitting orifice, the pressure at the sensing orifice decreases and correspondingly decreases the pressure in the diaphragm chamber 105. Thus, as the vane 54 moves from a position $V_1$ in which it is entirely out of the gap, progressively into the gap, the pressure in the chamber 105 progressively decreases as shown by the chart of FIG. 7 from an upper value $P_1$ approximately the outlet pressure of the blower 91 to the minimum value $P_2$ when the vane 54 is in a position $V_2$ extending completely across the air stream from the transmitting orifice. In order to adapt the sensing apparatus to respond to both positive and negative deviations of the pile edge W3 from a desired path of travel, the pressure responsive diaphragm 101 is biased by a spring 100 and the spring pressure is adjusted by an adjusting screw so that the flow reversing valve 125 is biased to its midposition shown in FIG. 1 when the pressure in the chamber 105 is at an intermediate pressure indicated at $P_x$ in FIG. 7 and which pressure is produced when the vane 54 is in position $V_x$ intermediate the positions $V_1$ and $V_2$ and in which the vane partially interrupts the stream of air from the transmitting orifice to the sensing orifice.

In use, the web edge sensor is adjusted in a direction perpendicular to the plane of the web to position the web engaging member 55 on the base web W2 at a location where the base web is supported by the guide plate 36 to maintain the base web at a predetermined level. The sensor 41 is adjusted laterally along the rod 63 so that the web engaging member 54 contacts the pile edge W3 and moves the vane 54 to an intermediate position as shown in FIG. 2 and designated $V_x$ in FIG. 7, when the pile edge W3 is in the desired path of travel relative to the device D. If the pile edge W3 shifts inwardly or outwardly from this desired path of travel, the web engaging member will move laterally of the path of travel to respectively increase or decrease the pressure at the sensing orifice. For example, if the pile edge moves laterally inwardly relative to the desired path of travel (to the left as viewed in FIG. 2), the vane will move from the position $V_x$ toward the position $V_1$ and correspondingly increase in pressure in the chamber 105 of the pressure responsive operator 101 above the value $P_x$. This causes the control valve member 125 to move upwardly and supply fluid under pressure through line 126 to the outer end of the fluid actuator cylinder 43*a* to move the device D inwardly. In the web chasing system shown in FIG. 1, the web edge sensor 41 is mounted to follow movement of the device D and, as the device D moves inwardly, the web engaging member 55 contacts the pile edge W3 and moves the vane 48 back until it reaches its intermediate position $V_x$. Conversely, if the pile edge moves laterally outwardly relative to the desired path of travel, the web engaging member will move the vane 54 from the position $V_x$ toward the position $V_2$. This produces a corresponding reduction in pressure in the chamber 105 and causes the flow reversing valve 125 to move downwardly and apply fluid pressure through line 127 to the actuator cylinder 43*a* to move the device D outwardly. The device D continues to move outwardly until the pile edge W3 again reaches the preset path of travel relative to the device D.

The web edge sensor is thus mounted for movement in a path crosswise of the path of travel of the pile edge and generally parallel to the plane of the web to sense lateral deviations of the pile edge W3 from the desired path of travel. However, the pile edge W3 in many tufted materials such as carpeting and other tufted fabrics is not a firm line and the pile edge sensor will sometimes ride onto some of the tufts and even onto the raised pile W1. Under these conditions the web engaging member ceases to accurately sense the lateral position of the pile edge. In order to correct this condition, the web engaging member and sensor are arranged so as to modulate the pressure at the sensing orifice and produce a pressure signal thereat when the web engaging member rides onto the pile, which pressure signal is similar to that produced when the pile edge moves toward the web engaging member, that is outwardly relative to the desired path of travel. More particularly, it will be seen that the vane 54 can be moved from its intermediate position $V_x$ shown in FIG. 2 toward a position further blocking flow from the transmitting orifice to the sensing orifice in response to either lateral movement at the pile edge in a direction outwardly of the web, or raising of the web engaging member as shown in FIG. 5, when the web engaging member rides onto the pile W1. Therefore, if the web engaging member rides onto the pile, the vane is moved to a position decreasing the flow of air from the transmitting orifice to the sensing orifice and thereby reducing the pressure in the chamber 105 of the pressure responsive operator to shift the actuator 43 in a direction to move the device D outwardly. As the device D moves outwardly, the web engaging member can drop down alongside the pile edge W3 and the alignment apparatus will again operate to follow the pile edge W3.

Figure 6:
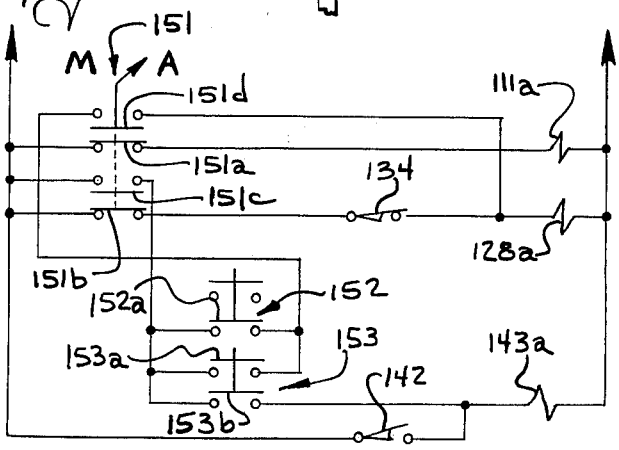
FIG. 6 is a schematic electrical circuit diagram of the web alignment apparatus.

There are sometimes irregular variations in thickness of the tufted fabrics such as carpeting due to transverse seams and the like. Since the sensing apparatus is arranged for operation by movement of the web engaging member 55 either in a direction paralleling the plane of the web or in a direction transverse to the plane of the web, such irregular changes of thickness of the web could cause operation of the sensor 41 to move the device D outwardly when the pile edge was not, in fact, moving outwardly of the desired path of travel. Provision is advantageously made for locking the device D against movement when irregular change in the web thickness passes the sensor 41. As diagrammatically shown in FIG. 1, the actuator control valve 128 provided in the lines 126 and 127 is movable between an open position as shown to allow fluid flow from the lines 126 and 127 to the actuator 43 and a closed position blocking flow from opposite ends of the actuator cylinder 43*a* to lock the actuator against movement. The valve 128 is operable under the control of an electroresponsive operator 128*a* between its open and closed positions and the valve is conveniently of the normally closed type which is actuated to its open position when the actuator 128*a* is energized. A switch 134, conveniently mounted on the support plate 61, is provided for controlling energization of the electroresponsive operator 128*a*. The switch has an actuator finger 134*a* which is engaged by a screw 135 adjustably carried by the arm 68 at a location spaced from the pivot axis 69. As shown in FIG. 6, the switch 134 is of the normally closed type and the screw 135 is adjusted so as to actuate and open the normally closed switch 134 when the web engaging member 55 is moved to a level above the level indicative of riding on top of the pile, and such as would occur if the web engaging member engaged an abrupt seam. As diagrammatically shown in FIG. 6, the switch 134 is connected in series with the electroresponsive actuator 128*a* for the valve 128 and, when opened, de-energizes the valve actuator so as to allow the valve to move from its open position shown in FIG. 1 to a closed position to lock the actuator 43 in the position it assumed at the instant that the web engaging member engaged a seam. As soon as the seam or other irregularity passes the web engaging member, switch 134 is allowed to reclose to energize the valve to its open position and the system returns to normal with the sensor 41 operating to maintain the device D in preselected relation to the path of travel of the pile edge W3.

In seaming carpets, some lateral misalignment of the carpet sections sometimes occurs and when the following carpet section is offset outwardly a substantial distance from the immediately preceding carpet section, the web engaging member 55 will ride on top of the pile. Provision is made for rapidly retracting the web sensor outwardly under these conditions to move the web edge sensor to the edge of the pile. This is achieved by a second limit switch 141 conveniently mounted alongside switch 134 on the support plate 61 and arranged for actuation by a second screw 142 connected to the arm 68. As shown in FIG. 6, switch 142 is normally open and the screw 142 is adjusted on arm 68 to actuate switch 142 to its closed position when the web engaging member 55 is moved a preselected distance above the normal level of the backing web W2, to a level indicative of the web engaging member riding on top of the pile and below the level at which the switch 134 is actuated by a seam. When switch 142 is closed, it energizes an electroresponsive actuator 143*a* of a normally closed air bleeder valve 143. As shown in FIG. 1, air bleeder valve 143 is connected through a line 144 to the outlet chamber 108 and is operative, when open, to reduce the pressure of the diaphragm chamber 105 and effect rapid retraction of the web sensor and the device D in a direction outwardly of the web.

An adjustable stop 146 is mounted on plate 61 to engage and prevent excessive downward movement of the arm 68 and adjustable stops 147, 148 are mounted on plate 61 to engage and prevent lateral movement of the arm 71.

Manually operable controls are also provided for operating the apparatus. As shown in FIG. 6, a manual-automatic switch 151 is provided and includes a contact member 151*a* operative in the automatic position shown and designated A, to complete a circuit to the electroresponsive actuator 94*a* for the valve 94 and a contact member 151*b* operative to complete a circuit through switch 134 to the actuator 128 for the control valve 128. The manual-automatic switch is movable to a manual position M in which contact 151*a* interrupts the circuit to the valve actuator 111*a* and contact 151*b* interrupts the circuit to actuator 128. In the manual position, a contact 151*c* on switch 151 establishes a circuit to normally open manually operable in and out switches 152 and 153. The in switch 152 is normally open and has a contact 152*a* operative, when closed, to complete a circuit through contact 151*d* on switch 151 to the valve actuator 128*a* for the valve 128 to energize the same to its open position. Since the valve 111*a* is de-energized and closed when the switch 151 is in its manual position, the pressure at the underside of the diaphragm will be above $P_r$ and cause the actuator to move the device D inwardly. When the manually operable out switch 153 is closed, contact 153*a* completes a circuit through contact 151*d* of switch 151 to the valve actuator 128*a* for the valve 128 to open the same and contact 153*b* also completes a circuit to the actuator 143*a* for the bleeder valve 143 to open the same and reduce the pressure at the underside of the diaphragm 101 and thereby cause the actuator 43 to move the device D outwardly.

From the foregoing it is thought that the operation and construction of the web alignment apparatus will be readily understood. The web engaging member 55 of the sensor 41 is movable from a normal position along a first path crosswise of the course of web travel at the sensing location and generally parallel to the path of the web to sense lateral deviations of the course of travel of the pile edge from the desired lateral position, and the web engaging member is also movable in a second path generally perpendicular to the plane of the web at the sensing location to sense if the web engaging member rides onto the pile. The web engaging member operates a vane in the gap-type sensor to modulate the pressure conditions at the sensing orifice when the web engaging member is moved in either the first or second paths. The pressure responsive actuator of the control system responds to the fluid pressure conditions at the sensing orifice and operates to shift the device D and the web relative to each other in a direction to correct lateral deviation of the pile edge relative to the device which operates on the web.

While a preferred embodiment of the present invention has been illustrated and described, this has been done by way of illustration and not limitation, and it is to be understood that various modifications in structure may be made within the scope of the appended claims.

The embodiments of the invention in which an exclusive property or privilege is claimed are defined as follows:

1. A web alignment apparatus for use with tufted webs and the like having a backing and a pile on the backing inwardly of the edge of the latter to maintain the pile edge in a preselected lateral position relative to a device which operates on the web, said web alignment apparatus including a gap-type pneumatic sensor having a sensing orifice at one side of the gap and a transmitting orifice at the other side of the gap for transmitting a stream of air toward the sensing orifice, vane means extending into the gap to variably interrupt the stream of air and thereby vary the pneumatic signal at the sensing orifice, a web engaging member adapted to engage the pile edge, means mounting said web engaging member for movement in a first path crosswise of the course of travel of the pile edge and generally parallel to the plane of the web to sense lateral deviations of the course of travel of the pile edge from said preselected lateral position and in a second path transverse to the plane of the web at the sensing location to sense if the web engaging member rides onto the pile, means operatively connecting said web engaging member to said vane means for moving the latter in the gap to variably interrupt the stream of air from the transmitting orifice in response to movement of the web engaging member along either said first or said second path, and power means responsive to variations in pressure at said sensing orifice produced by movement of said vane means crosswise of said stream of air for effecting relative shifting of said web and the device which operates on the web to maintain the pile edge in the preselected lateral position relative to the device which operates on the web.

2. An apparatus according to claim 1 wherein said vane means is constructed and arranged in relation to said gap-type pneumatic sensor to produce a preselected signal level at said sensing orifice when said web engaging member engages the pile edge at said preselected lateral position and to change the level of the pneumatic signal at the sensing orifice in the same preselected direction when the web engaging member either rides onto said pile or is moved laterally outwardly from said preselected lateral position by the pile edge.

3. An apparatus according to claim 2 including seam detecting means for preventing said power means from effecting relative shifting of said web and the device that operates on the web when the web engaging member engages a seam on the web.

4. An apparatus according to claim 3 wherein said seam detecting means includes means actuated when the web engaging member is moved along said second path to a position above a position corresponding to that which occurs when the web engaging member rides onto the pile.

5. An apparatus according to claim 1 including seam detection means operative when the web engaging member moves along said said second path to a position above a position corresponding to that which occurs when the web engaging member rides onto the pile for preventing said power means from effecting relative shifting of said web and the device which operates on the web.

6. An apparatus according to claim 1 wherein said means mounting said web engaging member includes a support member extending transverse to the plane of the web at the sensing location and supported for swinging movement in a plane transverse to the web and also for limited endwise movement in a direction perpendicular to the plane of the web, said web engaging member being connected to said support member for moving the latter and said vane member being connected to said support member for movement therewith.

7. An apparatus according to claim 6 including a second support member pivotally attached at one end to said first support member and extending transverse thereto and pivotally mounted adjacent its other end at a location fixed in relation to said preselected lateral position to thereby support said first support member by swinging movement and for limited lengthwise movement.

8. An apparatus according to claim 1 including a first means for adjusting the pressure exerted by the web engaging member in a direction along said first path against the pile edge and a second means for adjusting the pressure exerted by the web engaging member along said second path against the web.

9. In a web alignment apparatus for use with tufted webs and the like having a backing and a pile on the backing inwardly of the edge of the latter, pile edge sensing means for producing a pneumatic signal that varies in amplitude with the deviation of the pile edge from a preselected lateral position, and power means responsive to said pneumatic signal for relatively moving the web and a device that operates on the web to maintain the pile edge in a preselected lateral position relative to the device which operates on the web, the improvement comprising the pile edge sensing apparatus including a gap-type pneumatic sensor having a sensing orifice at one side of a gap and a transmitting orifice at the other side of the gap for transmitting a stream of air toward the sensing orifice and a vane extending into the gap to variably interrupt the stream from the transmitting orifice and thereby vary the pneumatic signal at the sensing orifice, a web engaging member adapted to engage the pile edge at a sensing location, a first support arm extending transverse to the plane of the web, a second arm extending transverse to the first arm, means mounting the second arm on a support for movement relative thereto about a second pivot axis that extends generally parallel to the pile edge of the web and having a preselected position relative to the sensing location, means pivotally mounting the first arm on the second arm for pivotal movement relative to the second arm about a first pivot axis that extends generally parallel to the pile edge of the web at the sensing location, means mounting said web engaging member on said first arm to effect swinging of said first arm about said first pivot axis relative to said second arm in response to movement in a path generally paralleling the plane of the web and laterally of the pile edge, said web engaging member being operative in response to movement thereof in a second path transverse to the plane of the web to move said first arm in a direction transverse to the plane of the web and thereby pivot said second arm about said second pivot axis relative to said support, means mounting said vane on said first arm for movement therewith, said vane being constructed and arranged with relation to said gap-type pneumatic sensor to vary the pneumatic signal at said sensing orifice in response to movement of said web engaging member along either said first or said second path.

10. A web alignment apparatus according to claim 9 including seam detecting means for sensing when the web engaging member is moved in one direction along the second path and transverse to the plane of the web to a position higher than that which occurs when the web engaging member rides onto the pile, and means responsive to said seam detecting means for rendering said power means inoperative to relatively move the web and the device that operates thereon.

11. A web alignment apparatus according to claim 10 wherein said seam detecting means includes means operated in response to movement of said second arm about said second pivot axis.

12. A web alignment apparatus according to claim 9 including means operated in response to movement of said second arm about said second pivot axis for detecting when the web engaging member moves along said second path to a position above the position at which the web engaging member engages the web backing, and means responsive to said last mentioned detecting means for operating said power means to relatively move the web and the device that operates thereon in a direction laterally outwardly of the web.

13. A web alignment apparatus according to claim 9 wherein said first arm extends generally upright, and weight means adjustably mounted on said first arm eccentric to said first pivot axis for yieldably urging said web engaging member against the pile edge.

14. A web alignment apparatus according to claim 13 including means connected to said second arm for yieldably counterbalancing the weight of said first and second arms and to adjust the pressure exerted by the web engaging member in a direction transverse to the plane of the web.

15. An apparatus according to claim 9 including a first means connected to said first arm for adjusting the lateral pressure applied by the web engaging member against the pile edge, and a second means connected to said second arm for adjusting the pressure applied by the web engaging member in a direction transverse to the plane of the web.

16. In an apparatus for operating on a traveling multilevel web of the type having a first lengthwise extending face portion disposed at one level and a second lengthwise extending face portion projecting above the first level and defining a step between the first and second face portions, a control system including sensing means at a sensing location for sensing the step between the first and second face portions and power means actuated by the sensing means for relatively shifting the web and the apparatus that operates on the web in a direction crosswise of the course of web travel to maintain the step in the web in a preselected lateral position relative to apparatus that operates on the web, the improvement comprising:

said sensing apparatus including a gap-type pneumatic sensor having a sensing orifice at one side of the gap and a transmitting orifice at the other side of the gap for directing a stream of air toward the sensing orifice, vane means extending into the gap to variably interrupt the stream of air and thereby vary the pneumatic signal at the sensing orifice, a web engaging member adapted to engage the step in the web, means mounting said web engaging member for movement along a first path crosswise of the course of travel of the web at the sensing location and generally parallel to the plane of the web to sense lateral deviations of the course of travel of the step from said preselected lateral position and in a second path generally transverse to the plane of the web at said sensing location to sense when the web engaging member rides onto said second face portion, means operatively connecting said web engaging member to said vane means for moving the latter in the gap to variably interrupt the stream of air from the transmitting orifice in response to movement of the web engaging member along either said first or said second path, said power means including means responsive to the fluid pressure conditions at said sensing orifice for relatively shifting the web and the apparatus which operates thereon in a direction to correct lateral deviation of the position of the step relative to the apparatus which operates on the web.

* * * * *